US010072360B2

(12) United States Patent
Nitta

(10) Patent No.: US 10,072,360 B2
(45) Date of Patent: Sep. 11, 2018

(54) YARN TWISTING DEVICE AND METHOD FOR PRODUCING TWISTED YARN USING THE SAME

(71) Applicant: CLOVER MFG. CO., LTD., Osaka-shi, Osaka (JP)

(72) Inventor: Kumiko Nitta, Osaka (JP)

(73) Assignee: CLOVER MFG. CO., LTD., Osaka (JP)

( * ) Notice: Subject to any disclaimer, the term of this patent is extended or adjusted under 35 U.S.C. 154(b) by 225 days.

(21) Appl. No.: 15/153,214

(22) Filed: May 12, 2016

(65) Prior Publication Data

US 2016/0340808 A1 Nov. 24, 2016

(30) Foreign Application Priority Data

May 20, 2015 (JP) ..... 2015-102516

(51) Int. Cl.
*D01H 17/00* (2006.01)

(52) U.S. Cl.
CPC ..... *D01H 17/00* (2013.01)

(58) Field of Classification Search
CPC .... D01H 17/00; D01H 7/02; A45D 2002/006; A45D 2/00
See application file for complete search history.

(56) References Cited

U.S. PATENT DOCUMENTS 775,125 A * 11/1904 Cline ..... D07B 3/14 313/325
2,935,838 A * 5/1960 Briscoe ..... D07B 3/12 57/21
3,667,790 A * 6/1972 Taylor et al. ..... A01K 91/04 289/17
4,369,690 A * 1/1983 Sapkus ..... A45D 2/00 132/212
4,580,585 A * 4/1986 Sapkus ..... A45D 2/00 132/212
4,583,561 A * 4/1986 Larsson ..... A45D 2/00 132/212
5,603,207 A * 2/1997 Hartman ..... D07B 3/12 57/25
5,671,759 A * 9/1997 Chung ..... A45D 2/00 132/212
5,678,400 A * 10/1997 Heard ..... D07B 7/18 57/2.3
5,988,181 A * 11/1999 Gable ..... A45D 2/00 132/200
6,109,275 A * 8/2000 Mendezmonsanto .... A45D 2/00 132/212

(Continued)

FOREIGN PATENT DOCUMENTS

JP 4805964 B2 8/2011

*Primary Examiner* — Shaun R Hurley

(74) *Attorney, Agent, or Firm* — Hamre, Schumann, Mueller & Larson, P.C.

(57) ABSTRACT

A yarn twisting device is simple in structure but capable of easily producing twisted yarn made of a plurality of yarn pieces twisted together. The yarn twisting device includes: a case; an operation wheel rotatably supported by the case so that an outer circumference of the operation wheel is partly exposed outside the case; and a plurality of yarn holding shafts supported by the case so as to protrude from one surface of the case and that axially rotate with the rotation of the operation wheel in the same direction.

9 Claims, 7 Drawing Sheets

(56) References Cited

U.S. PATENT DOCUMENTS

| | | | | | |
|---|---|---|---|---|---|
| 6,164,289 | A * | 12/2000 | Ogunro | A45D 2/00 | 132/210 |
| 6,318,378 | B1 * | 11/2001 | Kennedy | A45D 2/00 | 132/200 |
| 6,615,846 | B1 * | 9/2003 | Leason | A45D 2/00 | 132/212 |
| 6,662,808 | B2 * | 12/2003 | Leason | A45D 2/00 | 132/212 |
| 6,681,776 | B2 * | 1/2004 | Ogunro | A45D 2/00 | 132/212 |
| 6,962,159 | B1 * | 11/2005 | Adam | A45D 6/02 | 132/210 |
| 7,069,935 | B2 * | 7/2006 | Bousfield | A45D 2/00 | 132/210 |
| 7,124,918 | B2 * | 10/2006 | Rascoe | A45D 2/00 | 223/48 |
| 7,905,237 | B2 * | 3/2011 | Noh | A45D 2/00 | 132/210 |
| 2009/0283108 | A1 * | 11/2009 | Brouillard | A45D 7/00 | 132/212 |
| 2014/0338692 | A1 * | 11/2014 | Longoria | A45D 2/12 | 132/238 |

* cited by examiner

YARN TWISTING DEVICE AND METHOD FOR PRODUCING TWISTED YARN USING THE SAME

BACKGROUND OF THE INVENTION

1. Field of the Invention

The present invention relates to a yarn twisting device capable of giving twists to a plurality of yarn pieces simultaneously. The invention also relates to a method for producing twisted yarn made of a plurality of yarn pieces twisted together using such a device.

2. Description of Related Art

A yarn twisting device for producing twisted yarn for fancywork is disclosed in Japanese Patent No. 4805964. The conventional yarn twisting device has two kinds of turning function. By the first function, a plurality of yarn holding shafts of the device are each caused to rotate about a single axis of their own. By the second function, all the yarn holding shafts are caused to revolve around a common axis together. In use, each yarn holding shaft holds an end of a yarn piece, and is rotated ("first function") while the other end of the yarn piece is fixed to a desk, for example. This gives twists to the yarn piece. Then, the yarn holding shafts are revolved ("second function"). As a result, the yarn pieces are twisted together to provide a single piece of twisted yarn.

The above-described conventional yarn twisting device includes a wheel attached to van end of a handle to be gripped by the user. The first function is achieved by rotating the wheel in one direction, and the second function is achieved by rotating the same wheel in the opposite direction.

The conventional yarn twisting device, having two different kinds of turning function, is rather complicated in mechanism, which requires many components.

SUMMARY OF THE INVENTION

The present invention has been proposed to provide an improved yarn twisting device that is simple in structure. Another object of the present invention is to provide a method for producing twisted yarn using such a yarn twisting device.

According to a first aspect of the present invention, there is provided a yarn twisting device including: a case; an operation wheel rotatably supported in the case in a manner such that an outer circumference of the operation wheel is partly exposed to an outside of the case; and two or more yarn holding shafts supported by the case and configured to rotate in a same direction with the rotation of the operation wheel. Each of the yarn holding shafts has an end that protrudes from the case.

Preferably, the operation wheel includes a circular member having an inner circumference provided with gear teeth, and each of the yarn holding shafts includes a base portion provided with a pinion gear that is in mesh with the gear teeth.

Preferably, the case has a front wall, a back wall, a right side wall and a left side wall, and the yarn holding shafts protrude from the front wall.

Preferably, the operation wheel is located between the front and the back walls of the case, and the outer circumference of the operation wheel is partly exposed from at least one of the right side wall or the left side wall of the case.

Preferably, the case includes a grip portion, and the outer circumference of the operation wheel is partly exposed from both the right side wall and the left side wall of the case vat a position within reach of a thumb or forefinger of a user's hand gripping the grip portion.

Preferably, the outer circumference of the operation wheel is provided with knurls configured to prevent slipping.

In an embodiment, the yarn twisting device further includes a stopper configured to apply resistance to the rotation of the operation wheel.

Preferably, the stopper includes an engaging member configured to elastically engage with the knurls on the outer circumference of the operation wheel.

Preferably, each of the yarn holding shafts has a hook-shaped end.

According to a second aspect, of the present invention, there is provided a method for producing twisted yarn using a yarn twisting device according to the first aspect of the invention. The method includes: attaching an end of yarn to each of the yarn holding shafts; rotating the operation wheel, thereby axially rotating said each of the yarn holding shafts to give twists to the yarn; and suspending the yarn twisting device on the yarn so that the yarn twisting device rotates as the twists given to the yarn are untwisted.

In the yarn twisting device having the above-described configuration, the yarn holding shafts are axially rotated by, for example, rotating the operation wheel with the thumb of the user's hand that grips the case. This, simple operation of rotating the operation wheel gives twists to yarn pieces whose ends (first ends) are attached, to the respective yarn holding shafts.

Also, after the twists are given to the yarn pieces, the yarn twisting device is suspended on the yarn pieces with the second ends of the yarn pieces used as a suspension point. This permits the yarn twisting device to rotate by the force of the untwisting yarn pieces. Through this rotation of the yarn twisting device, the yarn pieces are twisted together. In this way, twisted yarn are produced, without utilizing any complicated mechanism for revolving the yarn holding shafts as with the conventional device.

Other features and advantages of the invention will become more apparent from the following detailed description taken with reference to the accompanying drawings.

DESCRIPTION OF PREFERRED EMBODIMENTS

Figure 1:
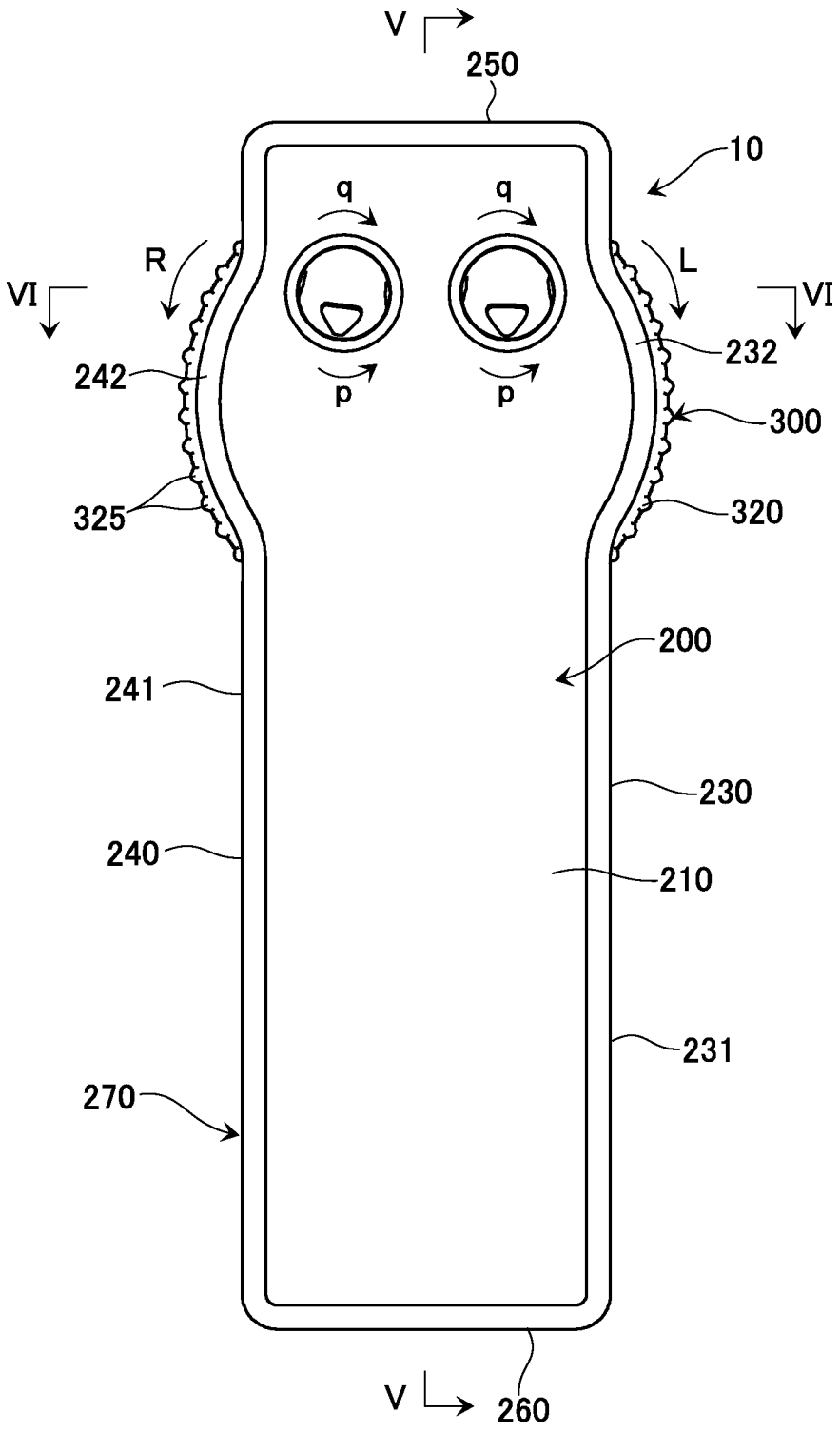
FIG. 1 is a front view of a yarn twisting device according to an embodiment of the invention.

Preferred embodiments of the invention will be described below with reference to the accompanying drawings.

FIGS. 1 to 6 show a yarn twisting device 10 according to an embodiment of the invention. The yarn twisting device 10 includes a case 200, an operation wheel 300, yarn holding shafts 40A and 40B, and a stopper 500 for applying appropriate resistance to the rotation of the operation wheel 300. In the illustrated embodiment, the stopper 500 is configured to provide a click feel in response to the rotation of the operation wheel 300, so that the user can sense the increments of rotation of the wheel.

The case 200 has a given thickness and is in a shape of a roughly elongated rectangular box when viewed from the front. More specifically, the case 200 has a front wall 210 and a back wall 220 as well as a right side wall 230, a left side wall 240, a top wall 250, and a bottom wall 260 each continuous with both the front wall 210 and the back wall 220. The front wall 210 and the back wall 220 define planes parallel to each other with a given space therebetween and are longer in a vertical direction than in a horizontal direction. The right and left side walls 230 and 240 respectively have: general portions 231 and 241 defining planes parallel to each other; and bulged portions 232 and 242 at positions near to the top wall 250. The bulged portions 232 and 242 each define an outward arc shape when viewed from the front and the arcs of the bulged portions 232 and 242 of the right and left side walls 230 and 240 constitute segments of one circle. The top wall 250 and the bottom wall 260 define planes parallel to each other and perpendicular to the front wall 210, the back wall 220, and the right and left side walls 230 and 240. A lower region of the case 200, i.e., a region where the right and left side walls 230 and 240 do not include the bulged portions 232 and 242 serves as a grip portion 270 to be gripped by the user. The case 200 is formed by joining a first member 201 constituting the front wall 210 side and a second member 202 constituting the back wall 220 side on top of each other so as to have a hollow interior. The first member 201 and the second member 202 may be formed by resin molding, for example.

Figure 4:
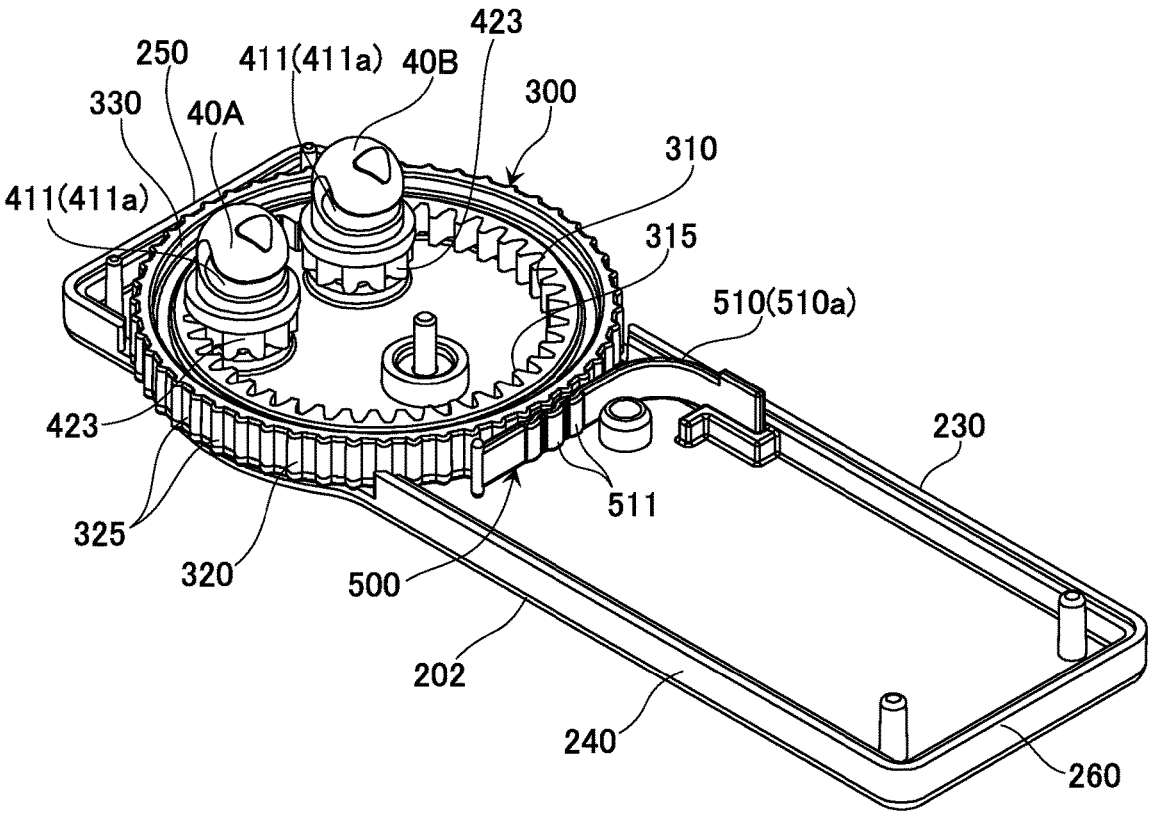
FIG. 4 is a perspective view of the yarn twisting device shown in FIG. 1 with a first member of a case removed to show an internal structure.

The operation wheel 300 generally has a circular shape and rotatably supported with respect to the case 200 in a space between the front wall 210 and the back wall 220. Portions of the outer circumference of the operation wheel 300 are exposed to the outside from slots 233 and 243 formed in the bulged portions 232 and 242 of the right and left side walls 230 and 240. More specifically, as is depicted in FIG. 4, the operation wheel 300 has an inner circumference portion 310 provided with gear teeth 315, and an outer circumference portion 320 (such as an undulated or knurled surface) provided with knurls 325. As will be described later, the gear teeth 315 converts the rotation of the operation wheel 300 to rotation of the yarn holding shafts 40A and 40B through meshing engagement with pinion gears 423 provided in base portions 420 of the yarn holding shafts 40A and 40B. The knurls 325 serve as a slip stopper when the user turns the operation wheel 300 with a finger and also serve as elements that provide a click feel in response to the rotation of the operation wheel 300.

Figure 5:
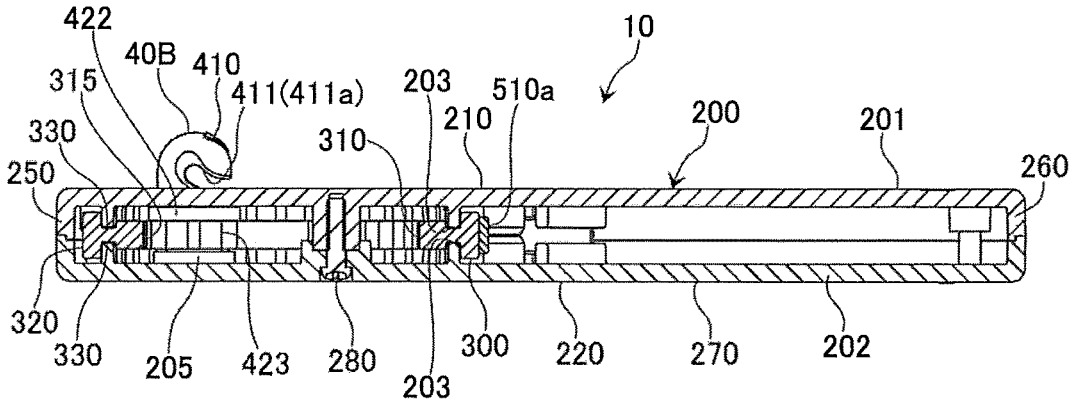
FIG. 5 is a cross-sectional view taken along line V-V in FIG. 1.
Figure 6:
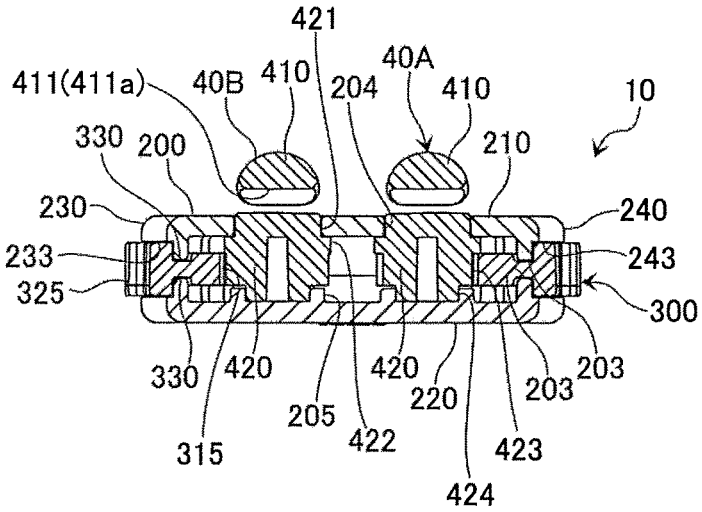
FIG. 6 is a cross-sectional view taken along line VI-VI in FIG. 1.

As is depicted in FIGS. 5 and 6, the operation wheel 300 has annular grooves 330, one in the front face and another in the back face. The annular grooves 300 have a depth in the thickness direction and are concentric with the operation wheel 300. On the other hand, the first and second members 201 and 202 of the case 200 each have an annular protrusion 203 received in sliding engagement within a corresponding one of the annular grooves 330. In this way, the operation wheel 300 is rotatably supported with respect to the case 200. The operation wheel 300 can be formed by resin molding, for example.

In this embodiment, the yarn holding shafts 40A and 40B are supported by the case 200 so as to be axially rotatable. As shown in FIGS. 5 and 6, the yarn holding shafts 40A and 40B have respective ends or top portions 410 that protrude from the front wall 210 of the case 200. The yarn holding shafts 40A and 40B are spaced apart from each other by a predetermined distance (see also FIG. 1).

More specifically, the yarn holding shafts 40A and 40B each have an axis orthogonal to the front wall 210 of the case 200, and also have the top portion 410 and the base portion 420. The base portion 420 is axially rotatably supported with respect to the case 200, and the top portion 410 protrudes beyond the front wall 210 of the case 200. As is depicted in FIG. 6, each of the base portions 420 of the yarn holding shafts 40A and 40B has a neck 421, a flange 422, the pinion gear 423, and a small-diameter part 424 in this order toward the lower end. The neck 421 passes through a support hole 204, which is formed through the front wall 210 of the case 200 (first member 201), so as to permit axial rotation. The small-diameter part 424 is received within a boss 205, which is formed in the inner surface of the back wall 220 of the case 200 (second member 202), so as to permit axial rotation. This ensures that the base portion 420 is axially rotatably supported with respect to the case 200, in an assembled state, the flanges 422 abut against the inner surface of the front wall 210 to regulate the positions of the yarn holding shafts 40A and 40B in the axial direction, preventing the shafts from dropping off. Note that the shaft diameter of the top portion 410 is equal to or less than the shaft diameter of the neck 421.

As described earlier, the pinion gears 423 on the base portions 420 of the yarn holding shafts 40A and 40B mesh with the gear teeth 315 on the inner circumference portion 310 of the operation wheal 300. The respective pinion gears 423 have the same number of teeth. Therefore, when the operation wheel 300 is rotated, the yarn holding shafts 40A and 40B axially rotate synchronously at a predetermined gear ratio determined by the ratio between the number of teeth on the gear teeth 315 and the number of teeth on each of the pinion gears 423.

The top portions 410 of the yarn holding shafts 40A and 40B each have a hook 411. That is, the top portion 410 is generally in a dome-shape and has a slit 411*a* that extends from its side face toward the upper end of the corresponding one of the yarn holding shafts 40A and 40B. The meshing positions between the pinion gears 423 and the gear teeth 315 are adjusted so that the hooks 411 of the yarn holding shafts 40A and 40B, i.e., the openings of the slits 411*a* thereof, face in the same direction at any time. Note that the yarn holding shafts 40A and 40B can also be formed by resin molding, for example.

The stopper 500 is constituted by an engaging member 510 that elastically engages with the knurls 325 on the outer circumference of the operation wheel 300. In this embodiment, as shown in FIGS. 4 and 5, the engaging member 510 includes a plate spring 510*a* having a knurled portion 511 at an end. The knurled portion 511 is profiled to have curves in conformity with the pitch of the knurls 325, and elastically pressed against the outer circumference of the operation wheel 300. Thus, as the operation wheel 300 is turned, the knurled portion 511 of the plate spring 510*a* elastically deforms to repeat engagement with and disengagement from the knurls 325 on the outer circumference of the operation wheel 300. This gives a predetermined degree of resistance to the user and thus provides a click feel in response to the rotation of the operation wheel 300.

In the yarn twisting device 10 having the above-described configuration, the outer circumference of the operation wheel 300 is partly exposed at positions near the grip portion 270 of the case 200. Therefore, the user gripping the grip portion 270 with one hand can turn the operation wheel 300 in a desired direction directly with the thumb or forefinger of the hand with. When the operation wheel 300 is rotated, the two yarn holding shafts 40A and 40B axially rotate in the same direction synchronously.

The yarn twisting device 10 can be assembled in the following manner.

As shown in FIG. 4, the operation wheel 300, the two yarn holding shafts 40A and 40B, and the plate spring 510*a* are placed on the second member 202 of the case 200 as illustrated. Thereafter, the first member 201 is placed on top of the second member 202, and the first and second members 201 and 202 are joined together with a tapping screw 280 (FIG. 5), ultrasonic welding, adhesive bonding, or any other appropriate means.

Figure 9A:
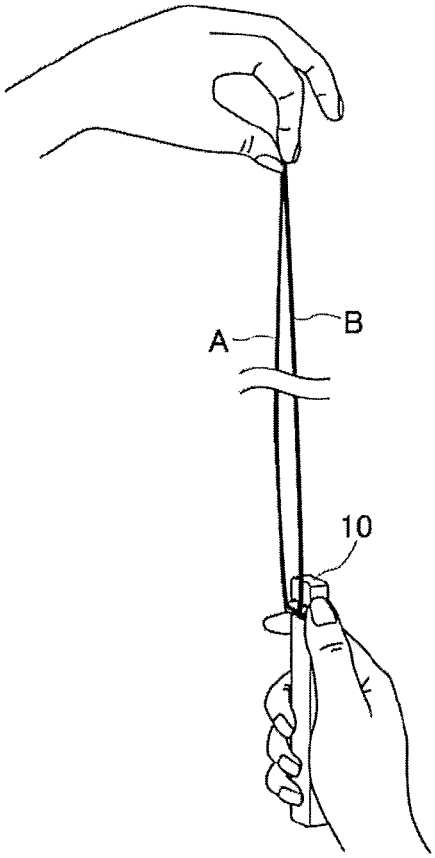
FIGS. 9A and 9B are explanatory views showing the example of the method for producing twisted yarn using the yarn twisting device shown in FIG. 1.
Figure 9B:
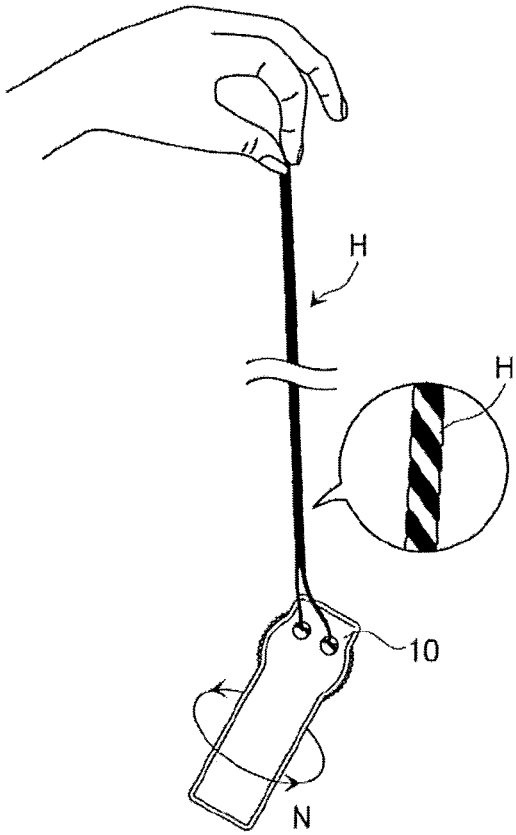

Next, an example method for producing twisted yarn H (FIG. 9B) using the yarn twisting device 10 having the above-described configuration will be described.

First, two yarn pieces A and B having the same length are prepared. The yarn pieces A and B are each made of a plurality of fiber bundles twisted together ("original twist"). Generally, yarn is either right-twisted yarn (ends of a plurality of fiber bundles are right-twisted) and left-twisted yarn (ends of a plurality of fiber bundles are left-twisted) according to the direction of twisting. The two yarn pieces A and B prepared in this embodiment have the same twist direction.

Figure 7:
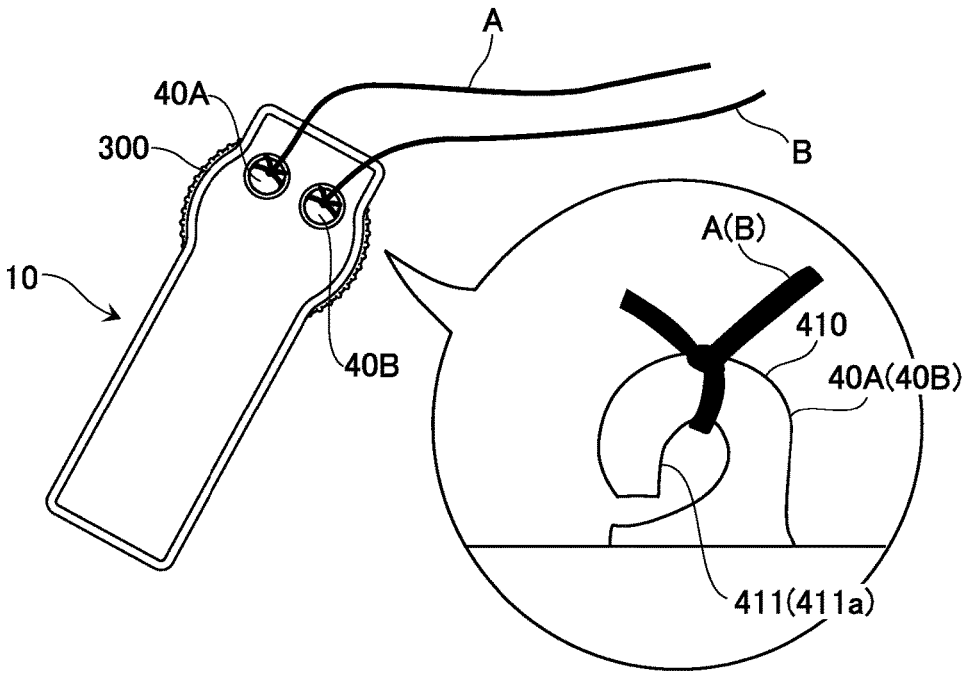
FIG. 7 is an explanatory view showing an example of a method for producing twisted yarn using the yarn twisting device shown in FIG. 1.

As shown in FIG. 7, the two yarn pieces A and B are then tied to, and thus held by the top portions 410 of the yarn holding shafts 40A and 40B of the yarn twisting device 10. More specifically, in this embodiment, the yarn pieces A and B are hooked into the slots 411*a* of the hooks 411 in the top portions 410 of the yarn holding shafts 40A and 40B and attached thereto. Preferably, the other (second) ends of the two yarn pieces A and B may be bound together.

Figure 8:
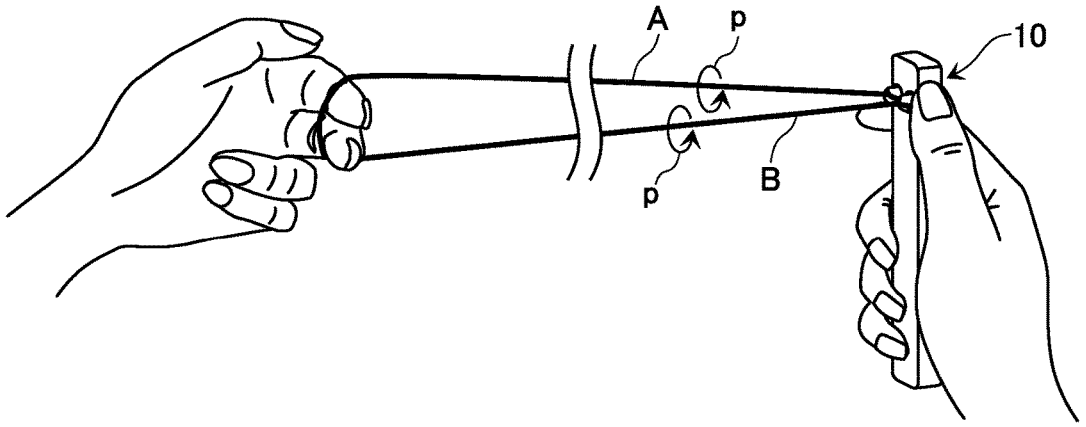
FIG. 8 is an explanatory view showing the example of the method for producing twisted yarn using the yarn twisting device shown in FIG. 1.

Thereafter, as shown in FIG. 8, the user grips the yarn twisting device 10 with the right hand, for example, and, while holding the second ends of the two yarn pieces A and B with the left hand to keep the yarn pieces A and B spaced from each other and stretched taut. The user then turns the operation wheel 300 in a predetermined direction with the thumb or forefinger of the right hand, causing the two yarn holding shafts 40A and 40B to axially rotate in the same direction. When the yarn pieces A and B are originally right-twisted, for example, the two yarn holding shafts 40A and 40B are axially rotated in a direction to give rightward twists to the yarn pieces A and B ("additional twist"). That is, turning the operation wheel 300 in the direction of arrow R in FIG. 1 axially rotates the yarn holding shafts 40A and 40B in the direction of arrow p in FIG. 1 a number of times. When the yarn pieces A and B are left-twisted, turning the operation wheel 300 in the direction of arrow L in FIG. 1, which is the direction opposite to the above, axially rotates the yarn holding shafts 40A and 40B in the direction of arrow q in FIG. 1 a number of times. In this way, additional twists are given to the two yarn pieces A and B.

Figure 2:
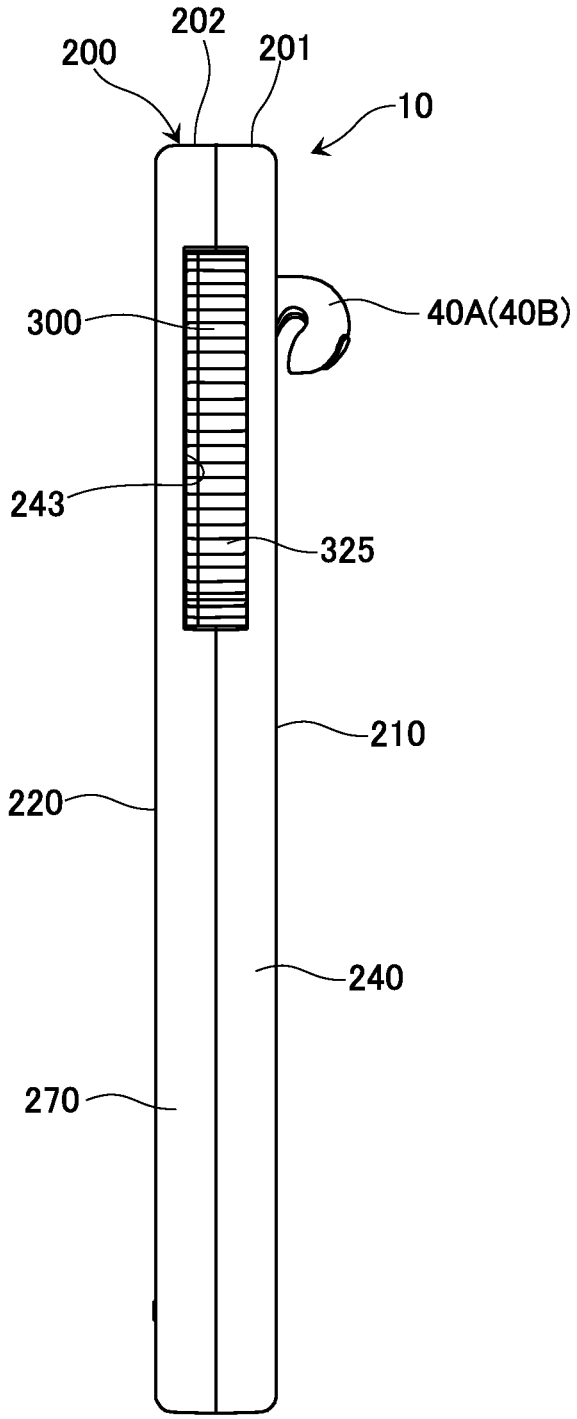
FIG. 2 is a left side view of the yarn twisting device shown in FIG. 1.
Figure 3:
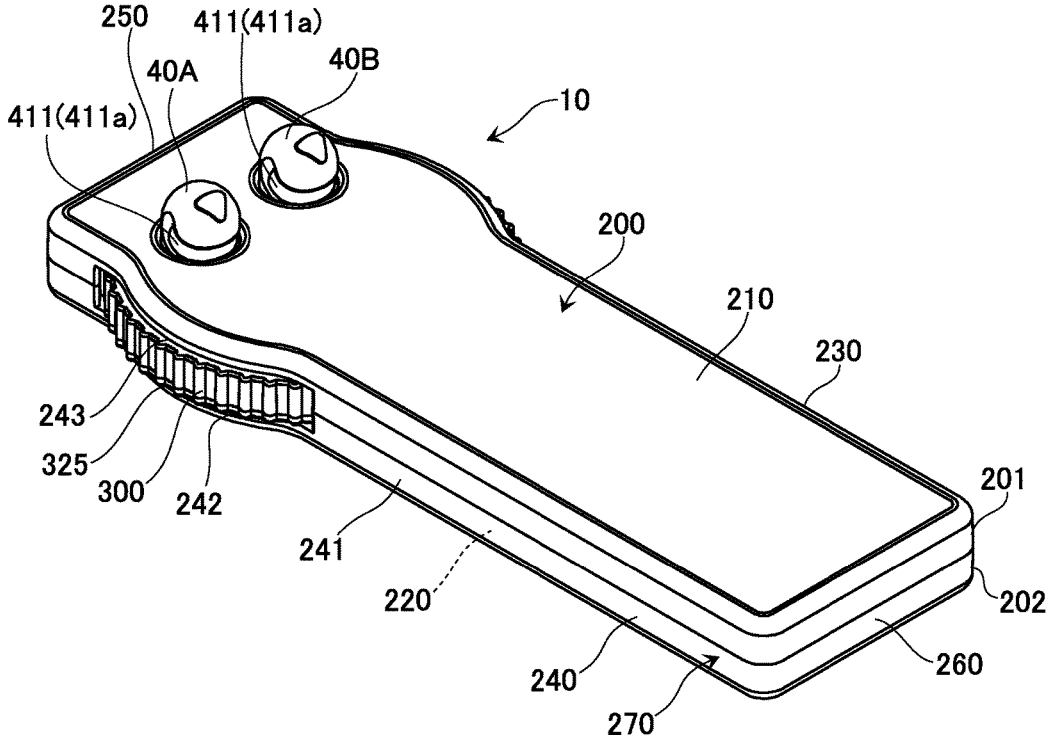
FIG. 3 is an overall perspective view of the yarn twisting device shown in FIG. 1.

The yarn twisting device 10 is then suspended by the two yarn pieces A and B with the second ends used as a suspension point. At this time, the yarn holding shafts 40A and 40B need to be positioned so that the slots 411*a* of the hooks 411 face downward as shown in FIGS. 2 and 3. This orientation of the holding shafts 40A and 40B prevents the first ends of the yarn pieces A and B from coining off the hooks 411 and thus prevents the yarn twisting device 10 from failing down. In this state, the entire yarn twisting device 10 starts to rotate in the direction of arrow N in FIG. 9B, for example, due to the untwisting of the additional twists given to the yarn pieces A and B. With this rotation, the two yarn pieces A and B are left-twisted together, producing the twisted yarn H. The force to untwist the additional twists given to the yarn pieces A and B acts to maintain the two yarn pieces in the twisted state. Therefore, the twists of the resultant twisted yarn H will not be readily untwisted.

Finally, the first ends of the yarn pieces A and B are released from the yarn holding shafts 40A and 40B, and unnecessary end portions may be cut off. The resultant twisted yarn H may be used as a desired fancywork element. The first ends of the yarn pieces A and B tied to the hooks 411 can be easily released from the yarn holding shafts 40A and 40B by slipping yarn pieces A and B out of the slots 243.

As described above, according to the yarn twisting device having the above-described configuration, the operation wheel 300 can be turned directly with a finger of one hand of the user gripping the yarn twisting device 10. Therefore, additional, twists can be easily given, to the plurality of yarn pieces A and B in the state where the respective first ends of the yarn pieces A and B are held by the yarn holding shafts 40A and 40B and the respective second ends are held by the other hand of the user, for example. Then, by simply releasing the yarn twisting device 10 from the hand to let the yarn twisting device 10 suspend by the yarn pieces A and B with the second ends acting as the suspension point, the yarn pieces A and B can be twisted. The twisted yarn H can therefore be produced very easily.

In addition, the yarn twisting device 10 having the above-described configuration can twist the plurality of yarn pieces A and B together using the untwisting force of the additional twists given to the yarn pieces A and B. Therefore, no mechanism of revolving the yarn holding shafts 40A and 40B, for example, is necessary. This simplifies the structure of the device, which results in the reduction of the number of components and hence of the cost of the device.

It is to be understood that the invention is not limited to the embodiment described above, but all design changes failing within the bounds of the appended claims are intended to be within the scope of the invention.

For example, while two yarn holding shafts 40A and 40B are provided in the above embodiment, three or more yarn holding shafts may be provided. Also, while the top portions 410 of the yarn holding shafts 40A and 40B are hook-shaped in the above embodiment, they may each have a ring at the top and an end of yarn may be attached to the ring. While the stop mechanism in the above embodiment provides a click feel in response to the rotation of the operation wheel 300. Alternatively, the stop mechanism may be configured to apply non-incremental, constant resistance to the rotation of the operation wheel 300.

The invention claimed is:

1. A yarn twisting device comprising:

a case;

an operation wheel rotatably supported in the case in a manner such that an outer circumference of the operation wheel is partly exposed to an outside of the case; and yarn holding shafts supported by the case and configured to rotate in a same direction with rotation of the operation wheel, each of the yarn holding shafts having an end that protrudes from the case, wherein the operation wheel comprises a circular member having an inner circumference provided with gear teeth, and each of the yarn holding shafts comprises a base portion provided with a pinion gear that is in mesh with the gear teeth.

2. The yarn twisting device of claim 1, wherein the case has a front wall, a back wall, a right side wall and a left side wall, and the yarn holding shafts protrude from the front wall.

3. The yarn twisting device of claim 2, wherein the operation wheel is located between the front and the back walls of the case, and the outer circumference of the operation wheel is partly exposed from at least one of the right side wall or the left side wall of the case.

4. The yarn twisting device of claim 3, wherein the case comprises a grip portion, and the outer circumference of the operation wheel is partly exposed from both the right side wall and the left side wall of the case, wherein the outer circumference is configured to be at a position within reach of a thumb or forefinger of a user's hand gripping the grip portion.

5. The yarn twisting device of claim 1, wherein the outer circumference of the operation wheel is provided with knurls configured to prevent slipping.

6. The yarn twisting device of claim 5, further comprising a stopper configured to apply resistance to the rotation of the operation wheel.

7. The yarn twisting device of claim 6, wherein the stopper includes an engaging member configured to elastically engage with the knurls on the outer circumference of the operation wheel.

8. The yarn twisting device of claim 1, wherein each of the yarn holding shafts comprises a hook-shaped end.

9. A method for producing twisted yarn using a yarn twisting device comprising a case; an operation wheel rotatably supported in the case in a manner such that an outer circumference of the operation wheel is partly exposed to an outside of the case; and yarn holding shafts supported by the case and configured to rotate in a same direction with rotation of the operation wheel, each of the yarn holding shafts having an end that protrudes from the case, the method comprising:

attaching an end of yarn to each of the yarn holding shafts;

rotating the operation wheel, thereby axially rotating said each of the yarn holding shafts to give twists to the yarn; and suspending the yarn twisting device on the yarn so that the yarn twisting device rotates as the twists given to the yarn are untwisted.

* * * * *